US006220254B1

(12) United States Patent
Gueret

(10) Patent No.: US 6,220,254 B1
(45) Date of Patent: Apr. 24, 2001

(54) PACKAGING AND APPLICATOR DEVICE COMPRISING A RECEPTACLE, AN ERGONOMIC APPLICATOR, AND A WIPER MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/188,149

(22) Filed: Nov. 9, 1998

(30) Foreign Application Priority Data

Nov. 14, 1997 (FR) ..... 97 14307

(51) Int. Cl.[7] ..... A45D 44/18; A46B 15/00

(52) U.S. Cl. ..... 132/313; 132/218; 132/317; 401/129; 401/126

(58) Field of Search ..... 132/313, 218, 132/320, 216, 317; 401/126, 129, 121, 122, 127; 15/DIG. 5, 172, 207.2, 160, 143.1, 144.1

(56) References Cited

U.S. PATENT DOCUMENTS

| | | | | |
|---|---|---|---|---|
| 1,905,399 | * | 4/1933 | Wagner | 132/313 |
| 1,999,642 | | 4/1935 | Shepherd . | |
| 2,029,835 | | 2/1936 | Reichle . | |
| 2,231,197 | * | 2/1941 | Scioscia | 132/320 |
| 2,296,139 | * | 9/1942 | Blair | 132/320 |
| 2,561,252 | | 7/1951 | Waring . | |
| 3,146,806 | | 9/1964 | Ginsburg . | |
| 4,165,755 | | 8/1979 | Cassai . | |
| 4,428,388 | | 1/1984 | Cassai et al. . | |
| 4,458,701 | * | 7/1984 | Holland | 132/218 |
| 5,137,387 | | 8/1992 | Byrd et al. . | |
| 5,188,131 | | 2/1993 | Toll . | |
| 5,309,929 | * | 5/1994 | Toll | 132/218 |
| 5,328,282 | * | 7/1994 | Charrier et al. | 401/127 |

FOREIGN PATENT DOCUMENTS

| | | | | |
|---|---|---|---|---|
| 62340/86 | | 7/1987 | (AU) . | |
| 1174544 | * | 3/1959 | (FR) | 132/218 |
| 1 246 217 | | 10/1960 | (FR) . | |
| 918901 | * | 2/1963 | (FR) | 132/320 |
| 2 285 101 | | 4/1976 | (FR) . | |
| 2 564 712 | | 11/1985 | (FR) . | |
| 97/31553 | * | 9/1997 | (FR) | 132/313 |
| 1 459 859 | | 12/1976 | (GB) . | |
| 55-5606 | | 1/1980 | (JP) . | |
| 2-147074 | | 6/1980 | (JP) . | |
| 55-76612 | | 6/1980 | (JP) . | |
| 58-40009 | | 3/1983 | (JP) . | |
| 60-9411 | | 1/1985 | (JP) . | |
| 60-18722 | | 2/1985 | (JP) . | |
| 62-2631 | | 1/1987 | (JP) . | |
| 9-125 | | 3/1997 | (JP) . | |
| WO 92/11785 | | 7/1992 | (WO) . | |
| WO 97/09905 | | 3/1997 | (WO) . | |
| WO 97/31553 | | 9/1997 | (WO) . | |

* cited by examiner

*Primary Examiner*—Pedro Philogene
(74) *Attorney, Agent, or Firm*—Oliff & Berridge, PLC

(57) ABSTRACT

The invention relates to a device for packaging and applying a substance that is a liquid, a semiliquid, or a powder, in particular a cosmetic product, the device comprising a receptacle that is open at one end, that is suitable for containing the substance, an applicator including at one end an applicator element and at its other end a handle element, and a link member interconnecting the applicator element and the handle element, the device further comprising a wiper member constituted at least in part by an elastically deformable porous material. The applicator element, the handle element, and the link member are not in alignment.

31 Claims, 5 Drawing Sheets

PACKAGING AND APPLICATOR DEVICE COMPRISING A RECEPTACLE, AN ERGONOMIC APPLICATOR, AND A WIPER MEMBER

The present invention relates to devices for packaging and applying a substance that is a liquid, a semiliquid, or a powder, and in particular a cosmetic product.

BACKGROUND OF THE INVENTION

The invention relates more particularly to a device of the type comprising a receptacle that is open at one end, suitable for containing said substance, and an applicator having at one end an applicator element and at its other end a handle element which can also be used as a cap for closing the receptacle. The applicator element and the handle element are interconnected by a link member such as a stalk. International application WO 97/31553 discloses a device in which the applicator element, the stalk, and the handle element are in alignment and in which the applicator element is inserted into the receptacle and is withdrawn therefrom via a wiper member constituted at least in part by an elastically deformable porous material such as a foam having at least 5% open cells.

OBJECTS AND SUMMARY OF THE INVENTION

The present invention seeks to provide a novel device of the above-specified type, making it possible in particular to facilitate the operation of applying makeup and to further increase the possibilities of applying novel cosmetic or care products.

In the packaging and application device of the invention the applicator element, the handle element, and the link member are not in alignment.

In other words, at least one of the link member and the applicator element is curved or bent so that the applicator element is off-axis relative to the direction in which the link member extends in its region adjacent to the handle element.

After making the invention, the Applicant company has observed in quite surprising manner that, even when inclined relative to the axis of the wiper member, the applicator element can be wiped in satisfactory manner by the wiper member, even though it could have been expected a priori that the inclination thereof would give rise to wiping that is unsatisfactory.

The invention makes it possible in particular to provide applicators that are more ergonomic, facilitating the operation of applying makeup and enabling the user to make herself up with even greater precision.

In a particular embodiment, the link member is bent.

Still in a particular embodiment, the link member is constituted by a stalk that flares at its end remote from the handle element to form a housing which serves for fixing the applicator element.

The housing can extend in a direction that is at a non-zero angle relative to the direction of the stalk in its region adjacent to said housing.

The applicator element can be implemented in a wide variety of ways.

In a particular embodiment, the applicator element is curved.

In another particular embodiment, the applicator element is substantially flat, and forms an angle with the direction of the link element in its region adjacent to the handle element.

In another particular embodiment, the applicator element presents corrugations.

In another particular embodiment, the applicator element has a core of rigid or semi-rigid material having connected thereto the link member so as to form a bend.

Still in a particular embodiment, the applicator element is made at least in part out of an injected plastics material, e.g. an elastomer.

In a particular embodiment, the applicator element has bristles.

In a particular embodiment, the applicator element is asymmetrical.

In a particular embodiment, the applicator element has at least one helical filament.

In another particular embodiment, the applicator element is generally curved in shape.

In another particular embodiment, the applicator element has one or more slots or cavities.

The packaging and application device of the invention can be used in particular for making up the eye, for applying nail varnish or the like, or indeed for applying lipstick or the like, the shape and the characteristics of the applicator element and the height and the density of the porous material of the wiper member being selected as a function of the nature of the substance, the purpose thereof, and the effect desired therefore.

The cross-section of the link member in its region that is in contact with the wiper member when the applicator is in place in the receptacle is preferably smaller than the cross-section of the applicator element.

When the link element is constituted by a stalk, the diameter of the stalk in its region extending in contact with the wiper element when the applicator is in place in the receptacle, preferably lies in the range 0.2 mm to 2 mm, and more preferably in the range 0.2 mm to 0.5 mm.

In a preferred embodiment, the wiper member is constituted by an axially slotted block of foam, with the edges of the slot or of the slots touching at rest. When the block of foam has a plurality of slots, they may be disposed in a cross or a star configuration.

Thus, wiping takes place preferentially by means of a block of foam which is not deformed substantially by the link member when the applicator is in place, having at least one slot and the ability to close up after the applicator has been removed.

The use of such a wiper member makes it possible to obtain very good results in terms of uniformity of substance distribution on the applicator element.

Preferably, the applicator element extends in line with the link element, being connected thereto via one axial end, with the other axial end of the applicator element constituting the free end of the applicator.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
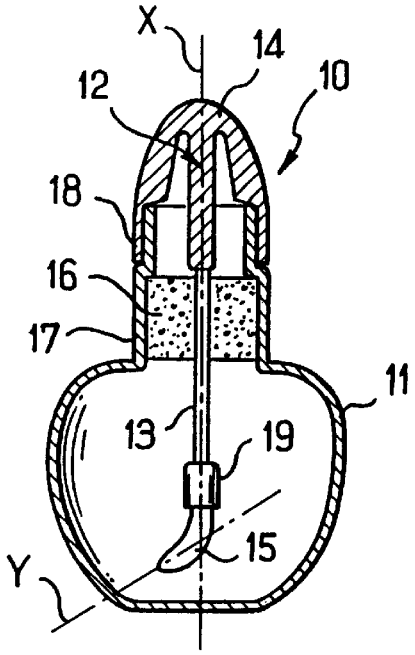
FIGS. 1 to 4 are diagrammatic axial sections of four packaging and applicator devices constituting respective variant embodiments of the invention.

The packaging and applicator device 10 shown in FIG. 1 comprises a receptacle 11 that is open at one end, together with an applicator 12.

The applicator comprises a rectilinear stalk 13 of axis X, provided at one end with a handle element 14 which constitutes a cap element for closing the receptacle 11. The stalk 13 has an applicator element 15 at its other end.

The receptacle 11 has a neck 17 which houses a wiper member constituted by a block of foam 16. This wiper member 16 is fixed via its radially outer surface to the neck 17, e.g. by adhesive.

The handle member 14 comprises an assembly skirt 18 with an inside thread for screwing on an outside thread on the neck 17 of the receptacle 11.

The above-mentioned block of foam 16 is axially slotted in the plane of FIG. 1 so as to allow the applicator element 15 to pass therethrough when it is withdrawn from the receptacle 11 in order to be used.

Reference can usefully be made to international application WO 97/31553 which describes various embodiments of the wiper member.

Preferably, care is taken to ensure that the foam of the wiper member 16 is not excessively compressed by the stalk 13 of the applicator 12 while it is in place in the receptacle, so as to avoid any risk of permanently deforming the foam, since that would spoil wiping quality.

The block of foam 16 can have an axial recess of diameter equal to or slightly less than the diameter of the portion of the stalk 13 that comes into contact therewith, or in a variant it may be axially slotted.

The stalk 13 may be made of metal in its smallest-diameter portion, and the diameter of said portion can lie in the range 0.2 mm to 0.5 mm, for example.

It will also be observed that because the block of foam 16 is stuck to the inside of the neck of the receptacle 11, the block is stiffened vertically and prevented from compressing axially when the applicator element 15 passes therethrough.

The bottom end of the stalk 17 expands to form a housing 19 on the axis X that serves to fix the applicator element 15, with the applicator element being received in part therein.

The applicator element 15 can be of any structure adapted to the type of makeup with which it is to be used.

In the example described, the applicator element 15 is curved and extends in a direction that makes a progressively increasing angle with the axis X on going towards the free end thereof. In the vicinity of the free end, the applicator element extends in a direction Y that is at an angle close to 60° relative to the axis X, for example.

The receptacle 11 is filled with a cosmetic, preferably a liquid, which is not shown in order to clarify the drawing.

Surprisingly, the applicator element 15 can be wiped in uniform manner as it passes through the block of foam 16 without leaving traces of excess substance, which traces could be detrimental to the quality of application of the makeup.

This result is achieved because of the porosity and the deformability of the block of foam 16 which is capable both of being impregnated with makeup that is present to excess on certain portions of the applicator element 15 and of depositing makeup by capillarity on other portions of the applicator element that are insufficiently charged therewith.

The block of foam 16 is adapted to wipe the stalk 13 while the applicator 12 is being withdrawn from the receptacle 11 for use, or while it is being put back into place.

Such wiping of the stalk 13 turns out to be particularly advantageous since it avoids any solid residue building up on the stalk because of drying.

To make the wiper member, it is possible to use an open-cell foam of polyurethane or polyether, for example.

Such a foam preferably comprises at least 5% of open cells, having a diameter lying preferably in the range 5 mm to 3 mm.

By way of example, the height of the block of foam 16 may lie in the range 1.5 mm to 80 mm.

Depending on the density of the foam and on the height of the block of foam, the wiper member will fit more or less closely to the outline of the applicator element as it passes through the block of foam.

Tests have shown that it is possible in some cases to deposit a film of substance on the applicator element that accurately matches the outline of the applicator element, while in other cases the film of product as held by surface tension hides any relief on the applicator element.

In general, the softer the applicator element, the more it tends to deform as it passes through the block of foam, and the smaller the amount of substance that remains on the applicator element after it has been wiped.

In particular, when the applicator element is a brush, the softer the bristles thereof, the more they tend to deflect and come close to the axis of the brush on passing through the wiper member and the smaller the quantity of substance that remains on the brush once the applicator has been fully extracted from the receptacle.

The orientation of the bristles when at rest can be arbitrary, for example they may extend perpendicularly to the axis of the handle element.

It will also be observed that if the substance contained in the receptacle is a liquid cosmetic whose solvent is water, for example an aqueous formulation of an acrylic or a polyurethane resin, then the block of foam can retain sufficient moisture until the substance in the receptacle has been used up to prevent the resin cross-linking within the foam, thus enabling it to moisten the stalk and the applicator element as they pass therethrough.

The block of foam constituting the wiper member can perform the following simultaneously:

- a mechanical action of wiping and cleaning the applicator element by pressing thereon and scraping off excess substance together with any solid residue that may have resulted from the substance drying out if it is a liquid or a semiliquid;
- an absorption action performed by capillarity;
- an absorption action performed by suction when the block returns to its initial shape after being locally compressed by the applicator element passing therethrough; and
- optionally an action of impregnating the applicator element with substance in the event of it carrying less substance than the wiper member.

It will be observed that the receptacle 11 is large enough to ensure that the applicator element 15 does not touch its wall when the applicator 12 is in place inside the receptacle 11.

It will also be observed that the opening of the receptacle 11 is large enough to allow the applicator element 15 to pass therethrough on being taken out of or put back into the receptacle 11.

To remove the applicator 12, the user unscrews the handle element 14 and then moves it upwards, parallel to the axis X.

The shape of the applicator element 15 may be suitable for enabling it to go through the block of foam 16 without it being necessary for the user to tilt the stalk 13.

It will be understood that the applicator element 15 passes more easily through the block of foam 16 if it is itself elastically deformable.

The shape of the applicator element 15 can also lead the user naturally to incline the stalk 13 when the applicator element 15 is passing through the block of foam 16.

To put the applicator back into position, the user inserts the applicator element 15 into the opening of the receptacle and pushes the applicator element 15 through the block of foam 16.

The block of foam is preferably sufficiently flexible to enable the applicator element 15 to pass back therethrough without any need for the user to pay particular attention or to put the applicator element 15 in any given orientation.

In the description below, the wiper member is similar and in FIGS. 2 to 4, it retains the reference 16. It is not described again in detail and reference can be made to the description above.

Figure 2:
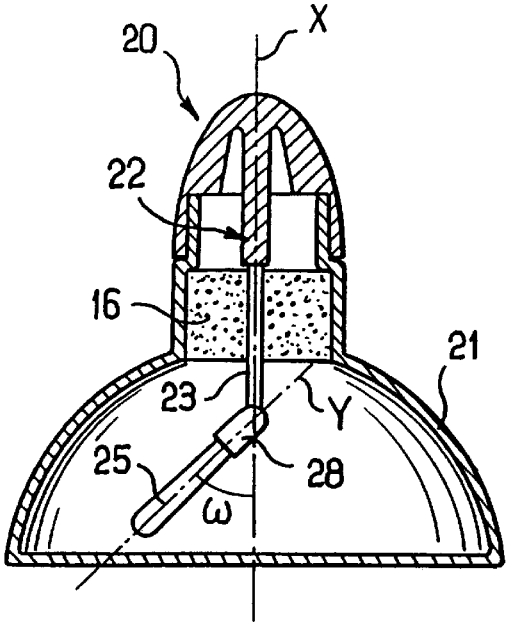

The packaging and applicator device 20 shown in FIG. 2 is similar to the device 10 as described above with respect to the handle element and the top portion of the receptacle, now referenced 21.

The applicator, now referenced 22, comprises a rectilinear stalk 23 of axis X extending to a bottom end where it enlarges to form an inclined housing 28 for fixing the applicator element 25.

The housing 28 extends along an axis Y which forms an angle w relative to the axis X of the stalk 23, where w is preferably greater than 10° and less than 60°, being about 45° in the example described.

The applicator element 25 is substantially rectilinear on the axis Y when at rest, but in a variant which is not shown it could be curved.

It should be observed that in the embodiment of FIG. 2, the stalk 23 needs to be inclined somewhat to return or extract the applicator element, since the applicator element is longer than the inside radius of the neck of the receptacle.

Figure 3:
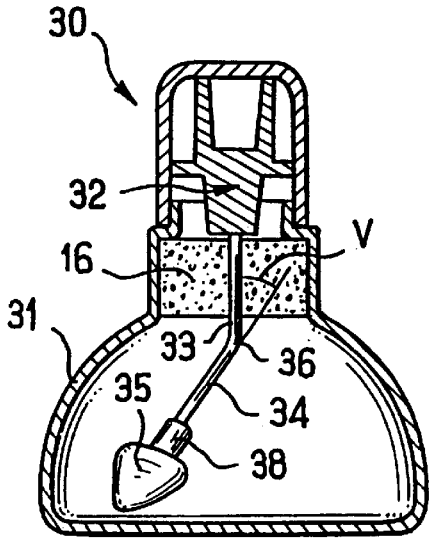

The receptacle can be closed other than by screwing the handle element onto the neck of the receptacle, and by way of example, FIG. 3 shows a packaging and applicator device 30 in which the handle element is held on the neck of the receptacle 31 by friction.

The applicator, now referenced 32, comprises a bent rod 33 having two rectilinear portions at an angle v to each other, where v preferably lies in the range 10° to 60°, and is equal to about 30° in the example described.

The bend 36 in the stalk 33 is situated immediately beneath the block of foam 16 when the applicator 32 is in place.

The applicator element 35 extends in line with the bottom rectilinear portion 34 of the stalk 33.

By way of example, the applicator element 35 is shown having a maximum transverse dimension that is about twice the diameter of the enlarged portion 38 of the stalk 33 at its bottom end, said enlarged portion 38 defining a housing in which the applicator element 35 is fixed.

Figure 4:
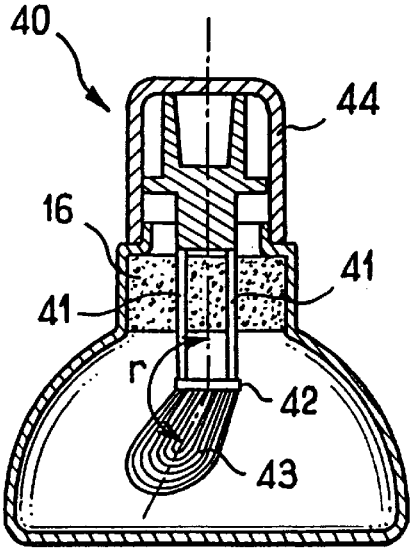

In the embodiment of FIG. 4, the link member between the handle element, referenced 44, and the applicator element, referenced 43, comprises two parallel rectilinear branches 41 which are interconnected at their bottom ends on either side of a housing 42 to which the applicator element 43 is fixed. The applicator element is constituted in this case by a plurality of concentric loops disposed substantially parallel to a common plane forming a dihedral angle with the plane of the branches 41, which dihedral angle r preferably lies in the range 100° to 170°.

The plane of the branches 41 is parallel to the section plane of FIG. 4, and to the plane of the slot made through the block of foam 16 through which the applicator element 43 passes.

In this case, it can be advantageous to provide means for indexing the angular position of the handle element relative to the neck of the receptacle on the neck of the receptacle and on the handle element 44 so that when the applicator is in place, the plane of the branches 41 coincides with the plane of the slot in the block of foam 16.

The branches 41 can be as small as possible in diameter so as to deform the foam very little.

Figure 5:
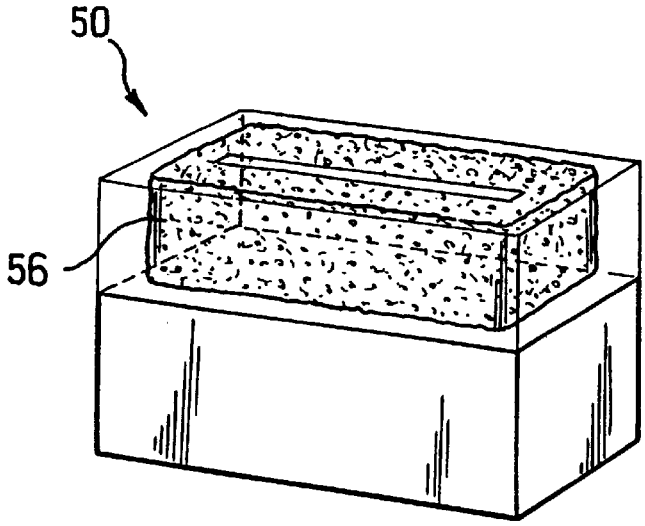
FIGS. 5 and 6 are two diagrammatic perspective views showing separately a receptacle and an applicator of a fifth embodiment of the invention.
Figure 6:
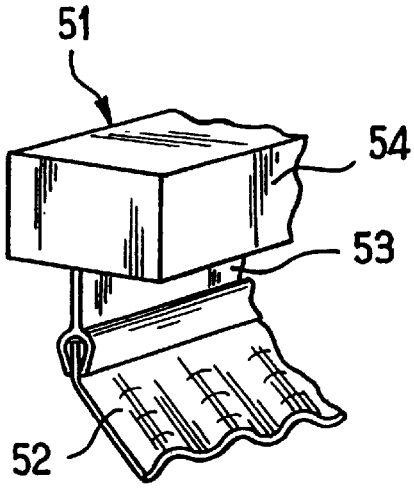

FIGS. 5 and 6 show a packaging and applicator device 50 in which the applicator 52 is very wide and has undulations.

The receptacle is shown in isolation in FIG. 5 while the applicator 51 is shown in isolation in FIG. 6.

The wiper member is constituted by a block of foam 56 substantially in the form of a rectangular parallelepiped that is slotted over a length that is sufficient to allow the applicator element 52 to pass therethrough.

The link element 53 connecting the applicator element 52 to the handle element 54 is constituted by a plane wall which thickens at its bottom end to form a groove in which the applicator element 52 is fixed.

The handle element 54 comprises a skirt surrounding the link member 53 and suitable for engaging on the receptacle to close it in sealed manner and to hold the applicator 51 in place.

The applicator element 52 can be wiped properly in spite of its undulations, because the foam is deformable.

The foam can thus be sufficiently flexible to come into contact with the troughs in the applicator element.

In the example described, the applicator element 52 extends in a direction that makes an angle of about 45° with the plane wall of the link member 53.

In general, the use of a block of foam for wiping purposes makes a wide variety of shapes possible for the applicator element.

Figure 7:
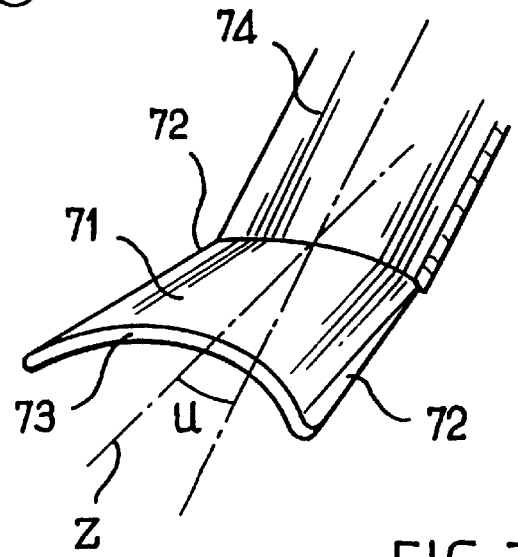
FIGS. 7 to 15 are diagrammatic perspective views of various embodiments of the applicator element.

By way of example, FIG. 7 shows an applicator element 71 which is curved in shape about an axis Z, which axis is at an angle u with the axis of the link element 74, where u preferably lies in the range 10° to 60°, with the applicator element 71 having a cross-section in a section plane perpendicular to the axis Z that is generally in the form of an arc of a circle.

The lateral edges 72 of the applicator element 71 diverge slightly on going away from the link member 74, and the edge 73 furthest from the link member 74 in the example described is of a shape that is slightly concave towards the outside.

The applicator element 71 is designed, for example, for applying makeup to the surface of a fingernail.

Figure 8:
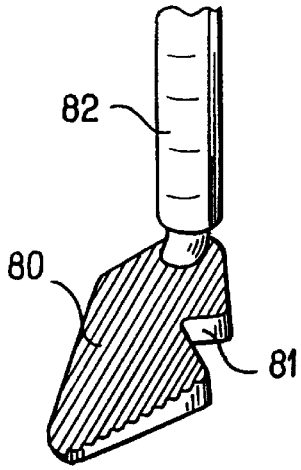

The applicator element 80 shown in FIG. 8 is asymmetrical in shape, being provided with a notch 81 on one side.

This applicator element 80 is made, for example, out of a porous material.

By selecting the foam of the wiper member to be sufficiently dense to ensure that it does not reach the bottom of the notch 81 during wiping, it is ensured that substance remains in the bottom of the notch 81 after wiping.

The notch 81 can thus constitute a supply of substance enabling the applicator to be used to a greater extent after it has been removed from the receptacle.

The applicator element 80 extends in a direction that is at a non-zero angle relative to the axis of the link member 82, as can be seen in FIG. 8.

The applicator element 80 also includes fluting, as shown.

Figure 9:
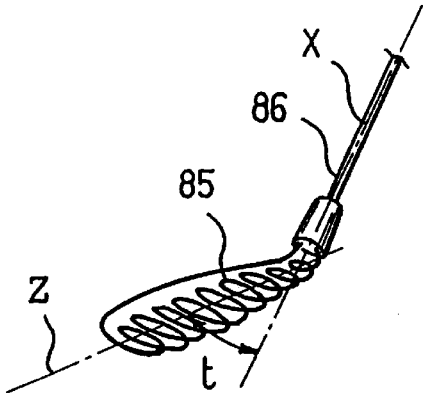

The applicator element 85 shown in FIG. 9 comprises a helical filament of axis Z extending at an angle t relative to the axis X of the stalk 86.

This angle t can be close to 30°, for example.

Figure 10:
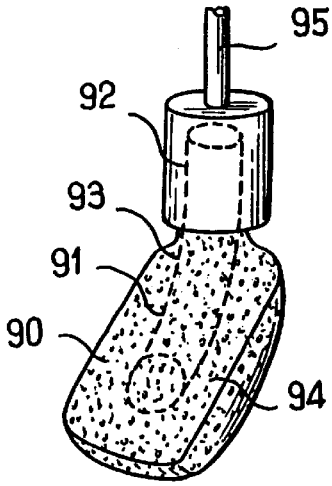

FIG. 10 shows an applicator element 90 having a core 91 of semi-rigid plastics material comprising two branches 91 and 92 that are interconnected by a bend 93, the branch 92 being engaged in a housing formed at the bottom end of the stalk 95 of the applicator. The other branch 91 serves to stiffen and support a block of foam 94 for applying the substance.

Figure 11:
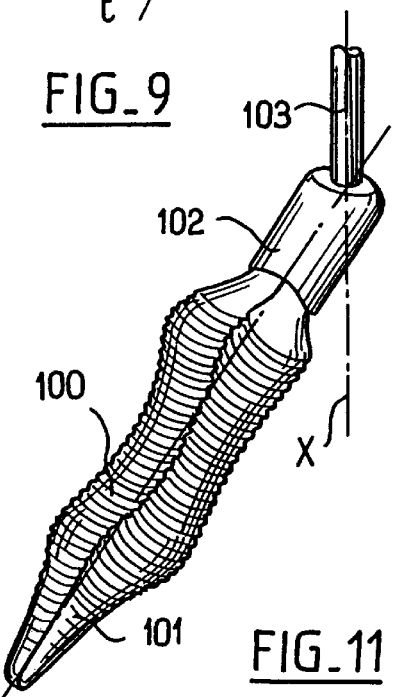

FIG. 11 shows an applicator element 100 that is generally elongate in shape along an axis U, and of substantially trapezoidal cross-section.

Each face of the applicator element is slightly indented so as to be concave towards the outside.

The applicator element 100 has a tapering end 101.

By way of example, the applicator element 100 can be made by injecting a rigid, a semi-rigid, or an elastomer plastics material.

In the example described, the applicator element 100 is inserted in a housing formed at the bottom end 102 of the stalk 103 of the applicator, said housing forming a non-zero angle with the axis X of the stalk 103.

In a variant (not shown), the applicator element is integrally molded as a single piece with the stalk.

Figure 12:
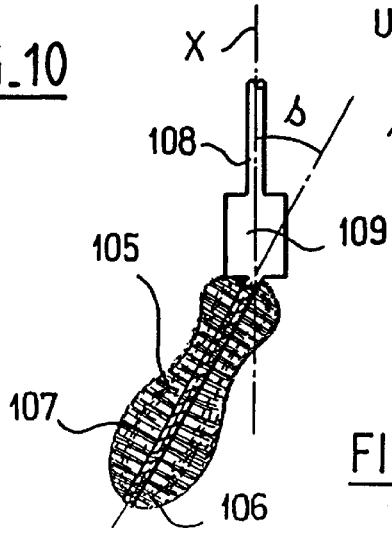

The applicator element may also be constituted by a brush whose outline can be arbitrary, and in particular can have portions of greater or smaller diameter, as illustrated by the applicator 105 shown in FIG. 12.

This applicator 105 has a metal core 106 constituted by twisted metal wires and it supports bristles 107, with the axis of the brush being at an angle s that is close to 30°, for example, relative to the axis X of the stalk 108.

In this example, the core 106 is bent and is fixed to the inside of a housing formed in an enlargement 109 of the stalk 108 at its bottom end, said housing being of axis X.

In a variant (not shown), this housing is inclined while the core of the brush is entirely rectilinear.

Figure 13:
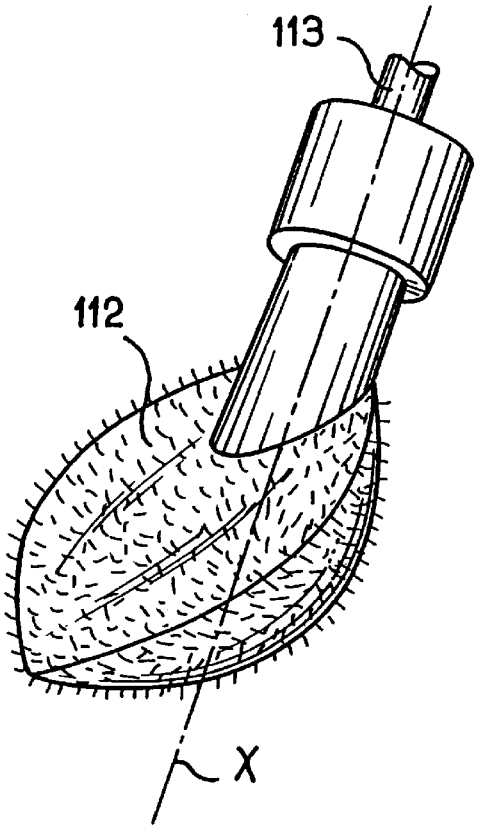

FIG. 13 shows an applicator element 112 whose surface is flocked, i.e. it is covered in fine hairs.

On examining this figure it will be observed that the applicator element 112 is non-symmetrical in shape about the axis X of the applicator stalk 113.

Because of its asymmetrical shape, it can be considered that the applicator element 112 does not lie in line with the stalk 113.

Figure 14:
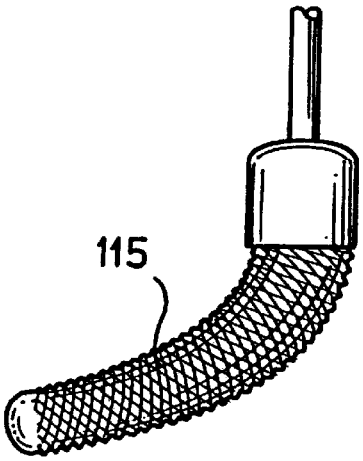

FIG. 14 shows an applicator element 115 that is curvilinear, extending substantially over one-fourth of a circle, that is generally circular in section, and that has a knurled surface.

This applicator whose general shape is similar to that of the applicator 15 described above, is made, for example, by injecting a plastics material.

Figure 15:
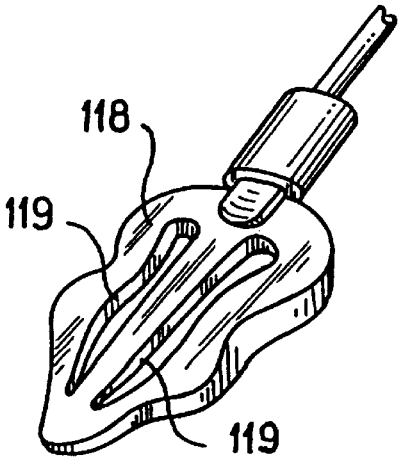

FIG. 15 shows an applicator 118 made by molding a plastics material and having slots or cavities 119.

By surface tension, these slots or cavities 119 serve to retain a supply of substance inside the applicator element 118 after it has been wiped, since it is difficult for the wiper member to penetrate therein.

Figure 16:
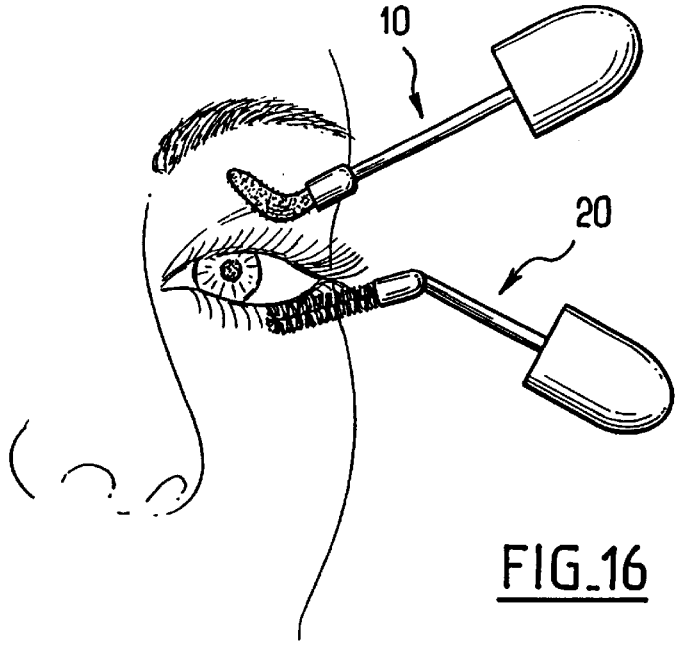
FIGS. 16 to 18 show the use of applicators of the invention in making up the eye, in applying nail varnish, and in applying lipstick, respectively.

FIG. 16 shows how the above-described applicators 10 and 20 can be used for making up the eye.

The use of an off-axis applicator element makes it easier for the user to make up the eye.

Figure 17:
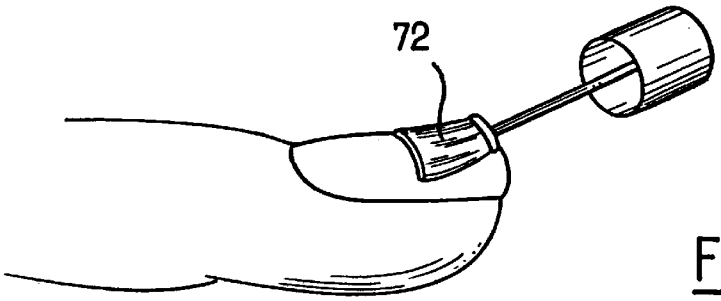

In addition, an off-axis applicator element of the invention, e.g. an applicator element 72 as described above, turns out to be very ergonomic in applying makeup to a fingernail, as shown in FIG. 17.

Figure 18:
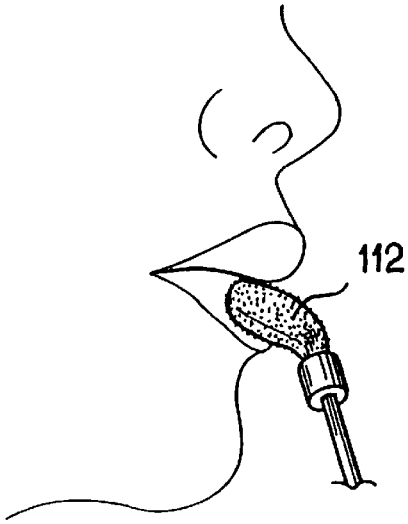

Finally, the asymmetrical applicator element 112 can be used to make up the lips, as shown in FIG. 18.

A packaging and applicator device of the invention can also be used for applying a hair-care product, for example.

It can be observed that when a stalk is used as a link member, the handle element can be oriented in an arbitrary direction relative to the neck of the receptacle when the applicator is in position provided the receptacle is large enough to receive the applicator element regardless of its orientation about the axis of the neck of the receptacle.

In all of the embodiments, the link member is preferably flexible to a certain extent.

Naturally, the invention is not limited to the embodiments described, and covers in particular any variant made by combining the characteristics specific to any of the embodiments described.

What is claimed is:

1. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end, and a link element interconnecting the applicator element and the handle element, said device further comprising a wiper member constituted at least in part by an elastically deformable porous material, wherein the applicator element, the handle element, and the link member are not in alignment, wherein the link element has one end and wherein the applicator element is connected by one end to the end of the link element.

2. A device according to claim 1, wherein the wiper member is constituted by a block of foam that is slotted axially, the edges of the slot(s) touching at rest.

3. A device according to claim 1, wherein the applicator element extends in line with the link element, being connected thereto via an axial end, another axial end of the applicator element constituting the free end of the applicator.

4. A device according to claim 1, wherein the link element is bent.

5. A device according to claim 1, wherein the link element is constituted by a stalk that flares at its end remote from the handle element to form a housing serving to fix the applicator element.

6. A device according to claim 5, wherein said housing extends in a direction at a non-zero angle with the direction of the stalk in its region adjacent to said housing.

7. A device according to claim 1, wherein the link member has at least two branches.

8. A device according to claim 1, wherein the applicator element is curved.

9. A device according to claim 1, wherein the applicator element forms a non-zero angle with the direction of the link member in its region adjacent to the handle element.

10. A device according to claim 9, wherein the applicator element is substantially flat.

11. A device according to claim 1, wherein the applicator element has undulations.

12. A device according to claim 1, wherein the applicator element has a core of rigid or semi-rigid material, which core is connected to the link element by forming a bend.

13. A device according to claim 1, wherein the applicator element is made at least in part of an injected plastics material.

14. A device according to claim 1, wherein the applicator element has bristles.

15. A device according to claim 1, wherein the applicator element is asymmetrical.

16. A device according to claim 1, wherein the applicator element includes at least one helical filament.

17. A device according to claim 1, wherein the applicator element has a cross-section that is generally in the form of an arc of a circle.

18. A device according to claim 1, wherein the applicator element has one or more slots or cavities.

19. A device according to claim 1, wherein the wiper member is constituted, at least in part, by a foam having at least 5% open cells.

20. A device according to claim 19, wherein the foam is made of polyurethane or of polyether.

21. A device according to claim 1, wherein the link member has, in its region extending in contact with the wiper member when the applicator is in place on the receptacle, a cross-section that is smaller than that of the applicator element.

22. A device according to claim 1, wherein the link member is constituted by a stalk, with the diameter of the stalk in its region extending in contact with the wiper member when the applicator is in place in the receptacle.

23. A device according to claim 22, wherein the diameter of the stalk in its region extending in contact with the wiper member when the applicator is in place in the receptacle is in the range 0.2 mm to 2 mm.

24. A device according to claim 22, wherein the diameter of the stalk in its region extending in contact with the wiper member when the applicator is in place in the receptacle is in the range 0.2 mm to 0.5 mm.

25. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting the applicator element and the handle element, said device further comprising a wiper member constituted at least in part by an elastically deformable porous material, wherein the applicator element, the handle element and the link element are not in alignment and wherein the wiper member is constituted by a block of foam that is slotted axially, the edges of the slot(s) touching at rest.

26. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting the applicator element and the handle element, said device further comprising a wiper member constituted at least in part by an elastically deformable porous material, wherein the applicator element, the handle element and the link element are not in alignment and wherein the link element and applicator element are made of plastics material.

27. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting the applicator element and the handle element, said device further comprising a wiper member constituted at least in part by an elastically deformable porous material, wherein the applicator element, the handle element and the link element are not in alignment, and wherein the applicator element comprises a core of rigid or semi-rigid plastics material, said core being connected to the link element.

28. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting the applicator element and the handle element, said device further comprising a wiper member constituted at least in part by an elastically deformable porous material, wherein the applicator element, the handle element and the link element are not in alignment, and wherein the applicator element is made of an elastomer.

29. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting the applicator element and the handle element, said device further comprising a wiper member constituted at least in part by an elastically deformable porous material, wherein the applicator element, the handle element and the link element are not in alignment and wherein the link element is constituted by a stalk that flares at its end remote from the handle element to form a housing serving to fix an applicator element, wherein said housing extends in a direction at a non-zero angle with the direction of the stalk in its region adjacent to said housing, and wherein said applicator element extends outside said housing.

30. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting in a non-adjustable manner the applicator element and the handle element, said device further comprising a wiper member constituted at least in part by an elastically deformable porous material, wherein the applicator element, the handle element and the link element are not in alignment, wherein the link element has one end and wherein the applicator element is connected by one end to the end of the link element.

31. A device for packaging and applying a substance that is a liquid, a semiliquid, or a powder, in particular a cosmetic product, the device comprising a receptacle that is open at one end and suitable for containing said substance, an applicator having an applicator element at one end and a handle element at the other end and a link element interconnecting in a non-adjustable manner the applicator element and the handle element, said device further comprising a wiper member constituted at least in part by an elastically deformable porous material, wherein the applicator element, the handle element and the link element are not in alignment and wherein the applicator element is made of an elastomer, wherein the link element has one end, wherein the applicator element is connected by one end to the end of the link element and wherein the applicator element has an axis, said axis making an angle with an axis of the wiper member when the applicator element passes therethrough.

* * * * *